US005662075A

United States Patent [19]

Lyndhurst

[11] Patent Number: 5,662,075

[45] Date of Patent: Sep. 2, 1997

[54] UNIVERSAL VALVE LIFTER BLOCK AND CAP FOR MOTORCYCLE ENGINES

[75] Inventor: F. Richard Lyndhurst, Costa Mesa, Calif.

[73] Assignee: Rivera Engineering, a California corporation, Whittier, Calif.

[21] Appl. No.: 726,766

[22] Filed: Oct. 7, 1996

[51] Int. Cl.[6] ..... F01L 1/14

[52] U.S. Cl. ..... 123/90.48; 123/90.65; 123/90.67

[58] Field of Search ..... 123/90.38, 90.48, 123/90.5, 90.65, 90.67

[56] References Cited

U.S. PATENT DOCUMENTS 4,173,954 11/1979 Speckhart ..... 123/90.48

5,253,621 10/1993 Dopson et al. ..... 123/90.48

5,347,965 9/1994 Decuir ..... 123/90.65

5,546,899 8/1996 Sperling et al. ..... 123/90.65

*Primary Examiner*—Weilun Lo

*Attorney, Agent, or Firm*—Edgar W. Averill, Jr.

[57] ABSTRACT

A universal valve lifter block and cap assembly for motorcycle engines. The valve lifter block is configured to accept several different caps. One of the caps which may be accepted is configured to hold a spring which is used to provide additional downward force on the tappet. This permits increased RPM's for a motorcycle engine. The valve lifter block and cap assembly can be installed without altering the cooling fins of the motorcycle engine.

3 Claims, 3 Drawing Sheets

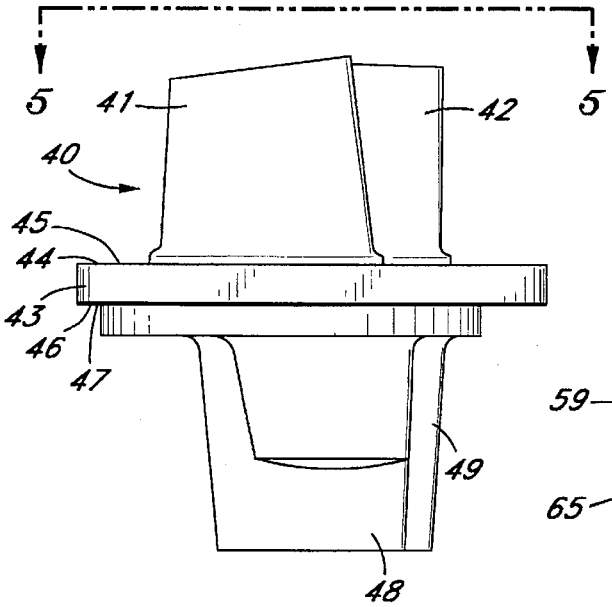
Fig. 2
Fig. 3
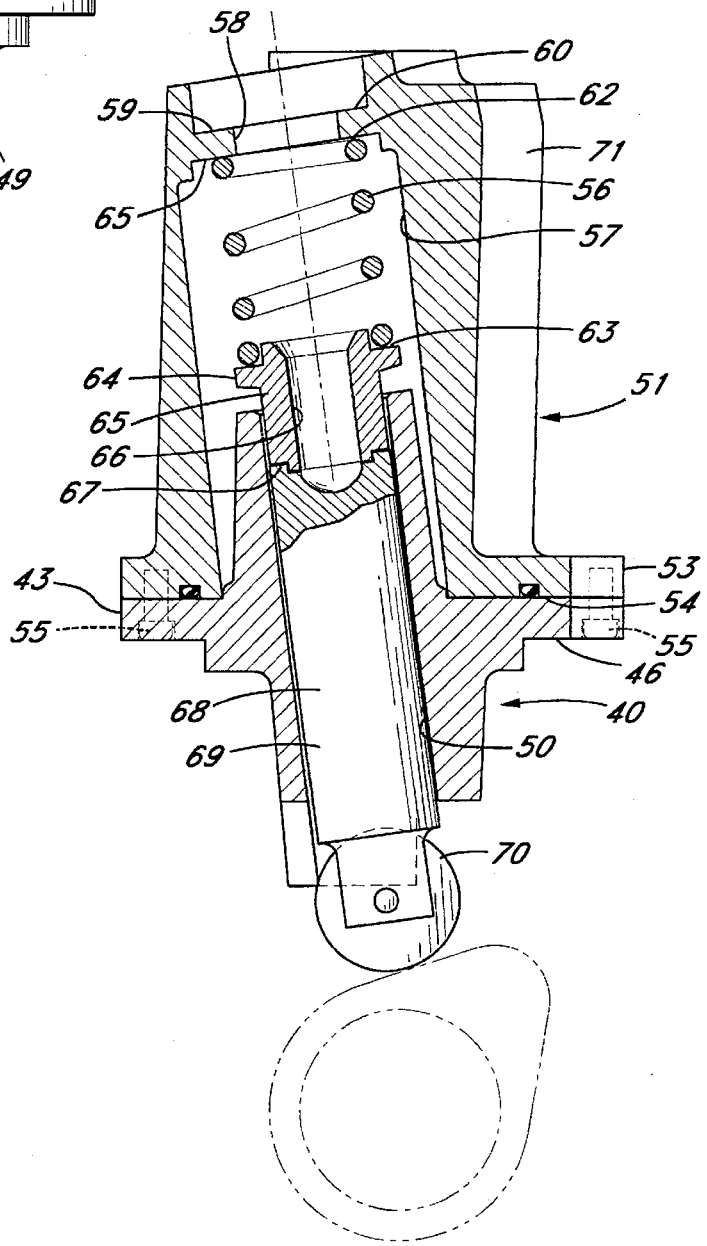

UNIVERSAL VALVE LIFTER BLOCK AND CAP FOR MOTORCYCLE ENGINES

BACKGROUND OF THE INVENTION

The field of the invention is motorcycle engines and the invention relates more particularly to the tappet, or valve lifter or cam follower, assembly. In order to increase the potential RPM of a motorcycle engine it has been found that by providing additional downward pressure on the tappet assembly, instead of relying only on the spring of the rocker arm, additional RPM's may be developed. Devices have been designed to accomplish this purpose but are cumbersome and require modifying the engine to which it is being fitted. Furthermore, a unit providing the capability of increasing RPM safely with the compactness required was unavailable.

BRIEF SUMMARY OF THE INVENTION

It is an object of the present invention to provide a universal valve lifter block and cap assembly which has the provision of utilizing a choice of cap, one of which is capable of supporting a spring to place additional downward pressure on the tappet assembly and hence providing a capability of increased RPM.

The present invention is for a universal valve lifter block and cap assembly for motorcycle engines. The assembly has a lifter block which has a central flange with an upper surface and a lower surface. The upper surface of the flange has a peripheral flat cap mating surface and the lower surface of the flange has a peripheral flat crankcase, camshaft housing mating surface. The lifter block has a pair of cylindrical shaped tappet support columns extending upwardly and downwardly from the central flange and at their appropriate angles for correct operation with the camshaft. These columns have cylindrical openings extending from end to end at the appropriate angles for correct operation with the camshaft and contain the tappet assemblies. A lifter cap having a bottom flange is shaped to mate with the upper peripheral surface of the central flange of the lifter block. The lifter cap has a pocket extending over the tappet guide block completely surrounding it and contains at the top, openings for the push rods from the tappets to pass through. Surrounding these openings are upward facing counterbores on the outside upper surface which receive the push rod tubular covers and their oil sealing rings. The extended lifter cap has spring support counterbores located in the underside of the lifter cap pocket positioned above the cylindrical openings in the tappet guide block. A pair of springs is located in the counterbores on their upper end inside the lifter cap pocket and on their lower end captured on a pair of hollow lifter (tappet) extensions located within the cylindrical openings in the tappet guide block and firmly on contact wit the lifters (tappets) which are operating against the camshaft. These springs provide a force in addition to the existing forces upon the lifter to keep it in contact with the camshaft profile during operation which is a desired feature. The extended cap may be attached to the tappet guide block to enable the springs and hollow lifter extensions to be preassembled prior to attaching to the engine block.

BRIEF DESCRIPTION OF THE DRAWINGS

FIG. 2 is a side view of the lifter block of the present invention.

FIG. 3 is a cross-sectional view of the lifter block of FIG. 2 and further including the lifter cap of the present invention in its extended version.

DESCRIPTION OF THE PREFERRED EMBODIMENTS

Figure 1:
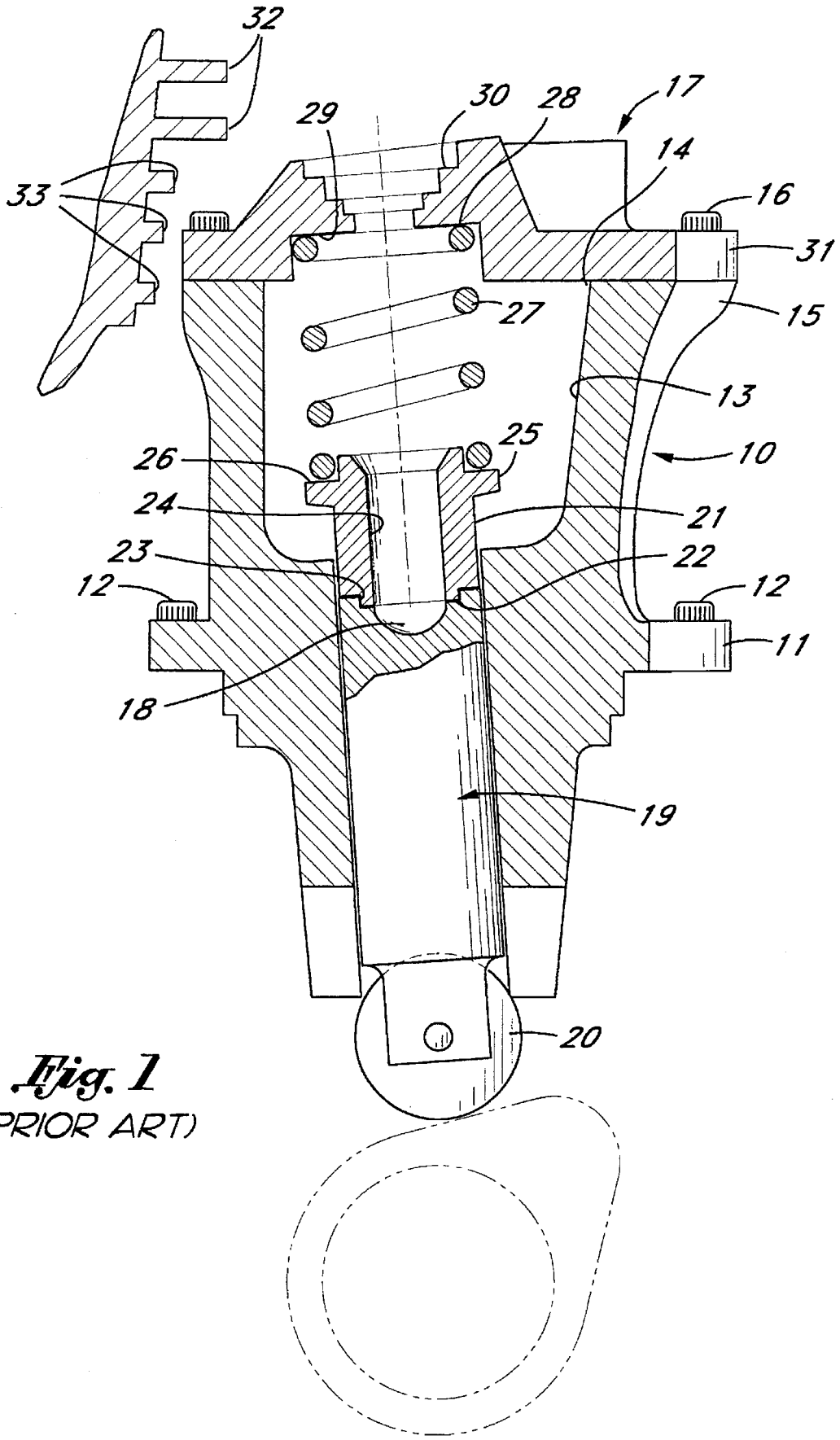
Fig. 1 (PRIOR ART)
FIG. 1 is a cross-sectional view of a prior art lifter block.

Before describing the device of the present invention, an earlier unsuccessful device will be described. This is shown in FIG. 1 and includes a lifter block 10 shown in cross-sectional view. Lifter block 10 has a central flange 11 which is bolted by bolts 12 to an engine block. Lifter block 10 has a central chamber 13 with an 6pen top 14. A flange 15 surrounds open top 14 and accepts bolts 16 which in turn hold a cap 17 in place. This device was designed for a motorcycle engine sold under the trademark Harley Davidson which like most motorcycle engines has push rods which are at an angle to one another. The cavity which holds the push rod is shown in cross-sectional view in FIG. 1 and the bottom end of the push rod is supported by a cup 18 at the upper end of tappet assembly 19. Tappet assembly 19 supports a roller 20 in a conventional manner. Lifter extension 21 has a bottom 22 which is held in a recess 23 at the top of tappet assembly 19. Lifter extension 21 is hollow and has a central opening 24 through which a push rod extends. A flange 25 supports the bottom end 26 of spring 27. The top 28 of spring 27 is held in a recess 29 in cap 17. Cap 17 also has a recess 30 for insertion of a push rod cover.

One of the difficulties with the design of the device of FIG. 1 was that the flange 15 of lifter block 10 and the flange 31 of cap 17 required that some of the cylinder cooling fins 32 had to be removed as indicated at reference character 33 so that the device could fit in the desired location. Also, this design being typically sand cast is not easily polished or otherwise decorated.

Turning now to the universal valve lifter block and cap assembly of the present invention, the lifter block 40 is shown in side view in FIG. 2. Lifter block 40 has two upwardly extending generally cylindrical shaped tappet support cylinders 41 and 42. These extend upwardly from a central flange 43. Each of these support cylinders extend from the central flange and one of the support cylinders on the central flange is shown in cross-sectional view in FIG. 4. Central flange 43 has an upper peripheral flat cap mating surface 45. Central flange 43 has a lower Surface 46 which has a peripheral flat camshaft housing mating surface 47. A pair of downwardly depending generally cylindrical shaped tappet support columns 48 and 49 extend downwardly from central flange 43. These also have a continuation of an inner tappet support cylinder 50 as shown in FIGS. 3, 4 and 5.

Figure 4:
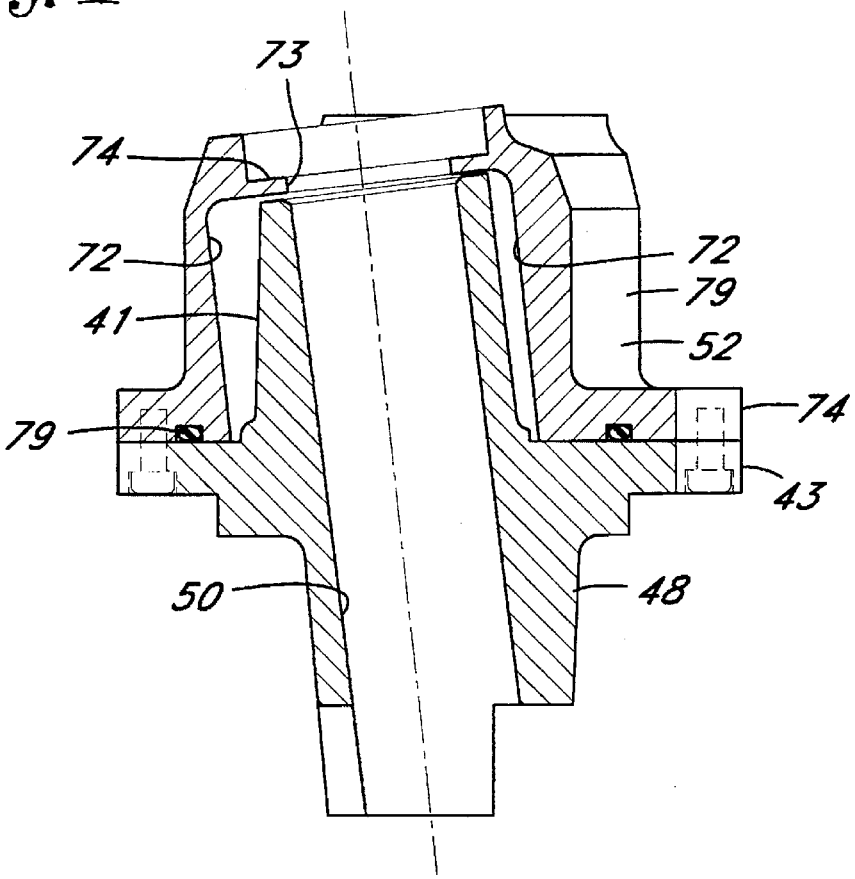
FIG. 4 is a cross-sectional view of the lifter body of FIG. 2 together with a basic lifter cap.
Figure 5:
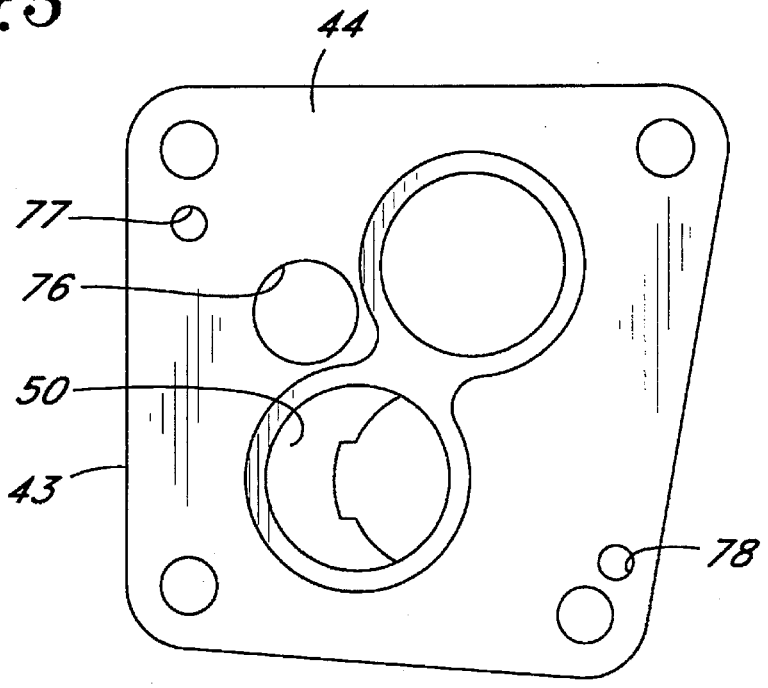
FIG. 5 is a top view of the lifter block of FIG. 2 taken along line 5—5 of FIG. 2.

FIGS. 3 and 4 show two different lifter body caps. An extended lifter cap 51 is shown in cross-sectional view in FIG. 3, and a basic lifter cap 52 is shown in cross-sectional view in FIG. 4. Lifter cap 51 has a bottom flange 53 which has a lower surface 54 which mates with the upper surface 45 of the central flange 43 of lifter block 40. It is preferably held to lifter block 40 by bolts 55 which may be tightened in either direction through the outer surfaces of flanges 53 or 43 but is preferably tightened from the lower surface 46 of central flange 43. In this way the extended lifter cap 51 may be screwed onto lifter block 40 and the spring 56 may be partially compressed before the total assembly is secured to the engine block.

A chamber 57 is formed within extended lifter cap 51. Chamber 57 has an opening 58 located on ring 59. Ring 59 has an upper surface 60 and a lower surface 65. Lower surface 65 is a counterbore which supports the top 62 of spring 56. The upper surface or counterbore 60 provides the base of a recess for holding the bottom of a push rod cover and seal.

Spring 56 has a lower end 63 which is held by a flange 64 near the top of lifter extension 65. Lifter extension 65 has a central opening 66 through which the push rod extends. Lifter extension 65 has a lower surface 67. The tappet assembly 68 has an upper cylindrical portion 69 which fits smoothly within the inner tappet support cylindrical opening 50 and contacts lifter extension 65 at its lower lifter contacting surface 67. Tappet assembly 68 has a roller 70.

The extended lifter cap 51 has an outer surface 71 which can easily be made to be smooth and thus easily polished, knurled or otherwise decorated. Outer surface 71 is also very compact and permits the installation of the assembly of the present invention adjacent the cylinder cooling fins without having to remove any portion of the cooling fins.

The assembly of the present invention also permits the use of a basic lifter cap 52 which has a shorter inner chamber 72. It also has a ring 73 with an upper surface 74 for supporting a push rod cover and seal. The lower surface 75 of ring 73 need not be formed to provide any internal support surface. Basic lifter cap 52 has a lower flange 74' which may be affixed to central flange 43 from either above or below these flanges. A seal 79' prevents oil from leaking out between the flanges and is applicable to all variations. Basic lifter cap 52 also has a smooth outer surface 79 which can readily be polished or otherwise embellished.

The lifter block is shown in top view in FIG. 5 where several additional features may be seen. An oil drain-back opening 76 permits oil to drain from above flange 43 into the engine block. Holes 77 and 78 show possible dowel locations for positive locations of lifter caps to central flange 43 on universal lifter block 40.

The universal lifter block 40 thus is capable of supporting at least two different kinds of caps and the caps may have smooth surfaces for ease of polishing. Furthermore, the caps are smaller at the top than they are at the bottom flange so that they can be installed Without interfering in any way with the cylinder cooling fins. They provide an attractive and effective way of permitting increased RPM by the downward pressure exerted on the tappet assembly 68 when the extended cap 51 with spring 56 is installed.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A universal valve lifter block and cap assembly for motorcycle engines of the type that have an engine block, a tappet assembly including an upper cylindrical portion, a push rod, a rocker arm actuating a valve and spring assembly biased to force the push rod and tappet assembly against a camshaft, said lifter block and cap assembly comprising:

a lifter block having a central flange having an upper surface and a lower surface, said upper surface having a peripheral, flat cap-mating surface and said lower surface having a peripheral, flat camshaft housing-mating surface, said lifter block having a pair of downwardly depending, generally cylindrical shaped tappet support cylinders extending downwardly from said lower surface, said downwardly depending, generally cylindrical shaped tappet support cylinders each having a cylindrical opening therethrough sufficient in size to support the upper cylindrical portion of said tappet assembly, and each of said cylindrical openings extending upwardly through said peripheral flat camshaft housing-mating surface, and said lifter block having a pair of upwardly extending, generally cylindrical shaped tappet support cylinders extending upwardly from said upper surface, and said pair of upwardly extending, generally cylindrical shaped tappet support cylinders each having a cylindrical opening comprising a continuation of said cylindrical openings of said downwardly depending tappet support cylinders; and a lifter cap having a bottom flange having an upper surface and a lower surface, said lower surface being flat and shaped to mate with the peripheral, flat cap-mating surface of the central flange of said lifter block, said lifter cap having a body extending upwardly from said bottom flange, said body having a chamber which surrounds said upwardly extending, generally cylindrical shaped tappet support cylinders, and said chamber having a pair of push rod passage openings each of said push rod passage openings being surrounded by a central ring having a lower surface and an upper surface and an opening for the passage of a push rod, and said upper surface of said central ring being smooth and shaped to mate with a push rod cover.

2. The universal valve lifter block and cap assembly of claim 1 wherein said lifter cap is an extended lifter cap and said assembly further includes:

a pair of spring support rings adjacent the lower surface of each of said central rings;

a pair of springs each having an upper end contacting one of said spring support rings, and each of said springs having a lower end, and said springs being located within said chamber of said extended lifter cap; and a pair of hollow lifter extensions, each of said lifter extensions having a central opening for passage of a push rod and having an upper spring support surface and a lower lifter contacting surface.

3. The universal valve lifter block and cap assembly of claim 2 wherein each of said hollow lifter extensions has an upper flange which contacts an upper end of said upwardly extending generally cylindrical shaped tappet support cylinders and said bottom flange of said extended lifter cap includes fastening means to tighten said bottom flange to said central flange of said lifter block whereby said spring may be compressed by tightening said fasteners from below said lower surface of said lifter block to assist in the installation of said universal valve lifter block and extended cap assembly.

* * * * *